US005565881A

United States Patent [19]

Phillips et al.

[11] Patent Number: 5,565,881

[45] Date of Patent: Oct. 15, 1996

[54] BALUN APPARATUS INCLUDING IMPEDANCE TRANSFORMER HAVING TRANSFORMATION LENGTH

[75] Inventors: James P. Phillips, Lake in the Hills; Louis J. Vannatta, Crystal Lake, both of Ill.

[73] Assignee: Motorola, Inc., Schaumburg, Ill.

[21] Appl. No.: 209,811

[22] Filed: Mar. 11, 1994

[51] Int. Cl.[6] ..... H01P 5/10

[52] U.S. Cl. ..... 343/859; 343/862; 343/864; 333/26

[58] Field of Search ..... 333/26; 343/859, 343/861, 862, 864

[56] References Cited

U.S. PATENT DOCUMENTS

| | | | |
|---|---|---|---|
| 3,614,676 | 10/1971 | Boelke | 333/26 |
| 3,678,418 | 7/1972 | Woodward | 333/26 |
| 3,846,721 | 11/1974 | Fritz et al. | 333/26 |
| 4,495,505 | 1/1985 | Shields | 333/26 X |
| 4,737,797 | 4/1988 | Siwiak et al. | 343/859 |
| 5,030,963 | 7/1991 | Tadama | 343/859 X |
| 5,304,959 | 4/1994 | Wisherd et al. | 333/26 |

FOREIGN PATENT DOCUMENTS

| | | | |
|---|---|---|---|
| 3445017 | 6/1985 | Germany | 333/26 |
| 148405 | 8/1984 | Japan | 333/26 |

OTHER PUBLICATIONS

Shuhao, Hu; "The Balun Family"; *Microwave Journal*; Sep. 1987; pp. 227–229, Copy Available.

*Primary Examiner*—Benny Lee

*Attorney, Agent, or Firm*—Kirk W. Dailey; Randall S. Vaas

[57] ABSTRACT

An electrical connection between a balanced circuit, such as a radio receiver and an unbalanced circuit, such as an antenna requires a balun. In a small electronic device such as a radiotelephone, a traditional balun is impractical because of the physical constraints. The balun function is performed by using a transmission line of minimum transverse dimensions and a predetermined length between the receiver and the antenna.

9 Claims, 3 Drawing Sheets

— PRIOR ART —

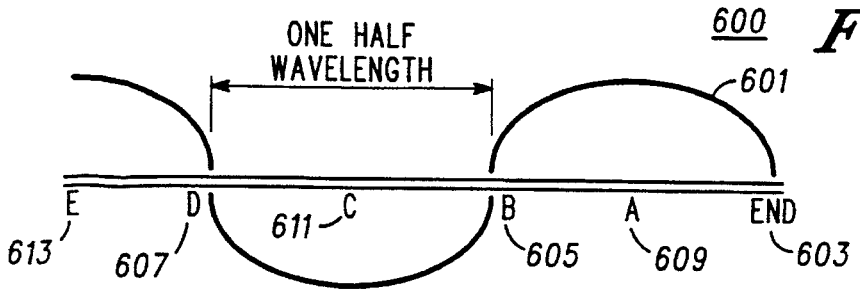
FIG. 6
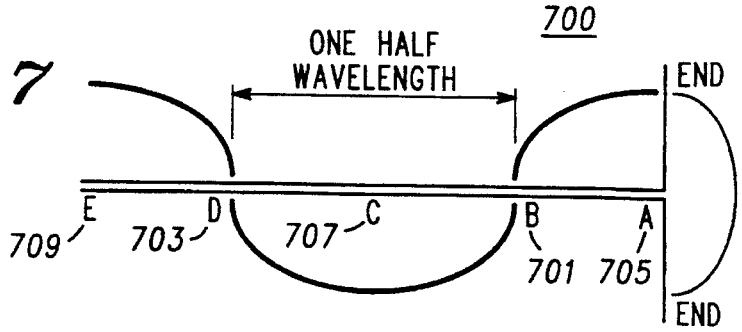
FIG. 7
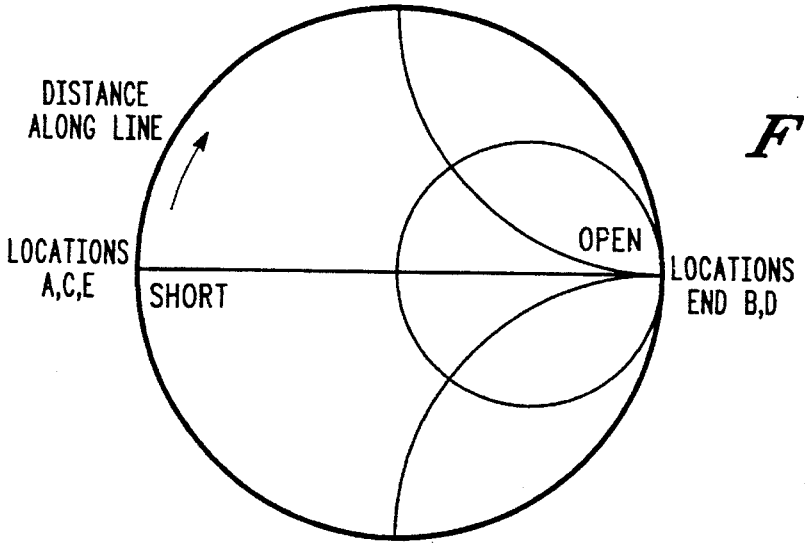
FIG. 8
FIG. 9
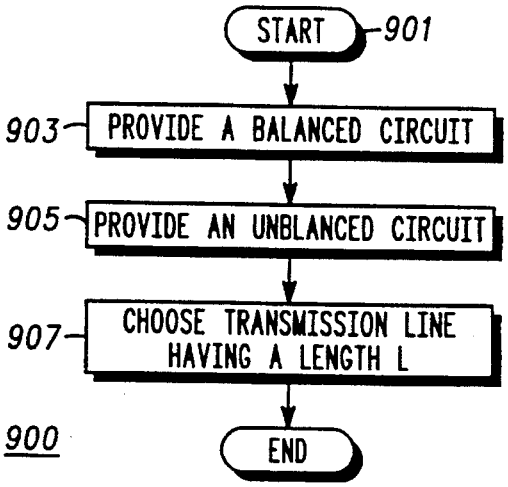

BALUN APPARATUS INCLUDING IMPEDANCE TRANSFORMER HAVING TRANSFORMATION LENGTH

FIELD OF THE INVENTION

Generally, this invention relates to baluns, and, more specifically, to a balun apparatus and a method of designing the balun apparatus.

BACKGROUND OF THE INVENTION

Typically in radio frequency (RF) communications systems, it is advantageous to use a balanced antenna. A balanced antenna reduces the RF current on the housing and other parts of the radio equipment, and the antenna is less susceptible to being detuned or being blocked by the operator. When connecting a balanced antenna with an unbalanced RF circuit the interface between the antenna and the unbalanced circuit requires a device called a balun.

In circuit technology, an unbalanced system (FIG. 1) is defined as one in which two conductors are at different potentials with respect to ground. One of the conductors is often at the ground potential. The capacitance with respect to ground of each of the two conductors is then different, consequently, the current in the two conductors may be different. A balanced system is one in which the potential of each of the two conductors are respectively above and below ground potential by the same magnitude. FIG. 1 illustrates a balun that electrically connects an unbalanced electrical source or lead and a balanced electrical source or load. FIG. 2 is an illustration of a simplified model of how currents are defined by a balanced and an unbalanced mode. In a RF transmit communication system, the source is the transmitter and the load is the antenna. Any configuration of currents Ia and Ib can be expressed as a combination of common mode and differential mode currents. Both the common mode and differential mode currents are determined by currents generated by either a balanced or an unbalanced source. The common mode current, shown as ICa and ICb in FIG. 2, have equal magnitude and equal phase. Consequently, the common mode currents contribute nothing to the intended operation of the load, or antenna, and are usually dissipated in heat. The differential mode currents, IDa and IDb, are equal in magnitude and opposite in phase, consequently, they manifest the power into the intended load. The source and the load losses of the common and the difference or differential modes can be represented as a circuit, as shown in FIG. 3. For balanced loads such as balanced antennas, the intended or desirable mode is the differential mode, and the unintended or undesired mode is the common mode. By maximizing the impedance of the common mode load, the currents and the loss associated with the common mode currents will be minimized.

A balun permits connection between a balanced system and an unbalanced system in such a way that the potentials to ground, and the currents in the two parts of the balanced structure are equal in magnitude and opposite in phase. In the past, balun transformers and transmission lines or "bazooka" baluns have been used to perform the balun function for an antenna feeder in a communication device used in a RF communication system. A balun transformer effectively performs the balun function, however, for use in such devices as portable radiotelephones, a balun transformer is large and absorbs power. Typically about 0.7 dB of power is lost through a balun transformer, thus, significantly reducing the amplitude of signal transmitted between the transceiver and an antenna. Second, "bazooka" balun, or transmission line, requires more than two conductors, or two conductors and a sleeve about those two conductors to perform the balun function. This "bazooka" balun requires very large physical space for a sleeve within a communication device.

Often, communication devices, such as a portable radiotelephone, are required to be physically small and less power-consuming than other non-portable or stationary communication devices. Thus, it is desirable in a portable radiotelephone to have an efficient transfer of power between the transceiver and the antenna, and to have a small physical size. Thus, it would be desirable to have an efficient and small balun device for transferring signals between a balanced antenna and unbalanced circuitry within a transceiver in a communication device.

BRIEF DESCRIPTION OF THE DRAWINGS

FIG. 6 is an illustration in graph form of the periodic cycles of common mode current for a differential load.

FIG. 7 is an illustration in graph form of the periodic cycles of common mode currents for a dipole antenna.

FIG. 8 is an illustration of a Smith chart describing common mode impedances and currents.

FIG. 9 is a flow chart illustrating a method of designing a balun device in accordance with the present invention.

DESCRIPTION OF A PREFERRED EMBODIMENT

A preferred embodiment of the present invention encompasses an RF communication device, specifically, a radiotelephone having diversity antennas, such as model number TH541, available from Motorola, Inc. In this particular radiotelephone, the physical size constraints are severe, particularly concerning the space available between a transceiver and an antenna; the radio receiver being an unbalanced load circuit and the antenna being a balanced source circuit. Since the electrical connection between the receiver and the antenna is an unbalanced-to-balanced connection a balun is required. A traditional balun, as discussed in the prior art, would be impractical because of the physical constraints. Thus, the balun function is performed by using a transmission line of minimum transverse dimensions and a predetermined length between the receiver and the antenna.

Figure 1:
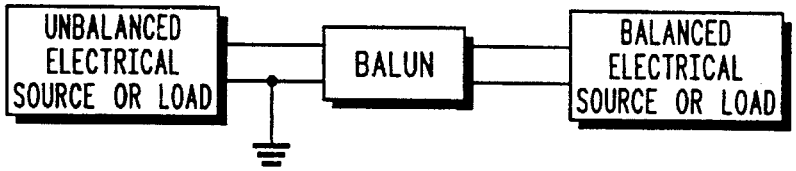
FIG. 1 is an illustration in block diagram form of an electrical circuit in the prior art.
Figure 3:
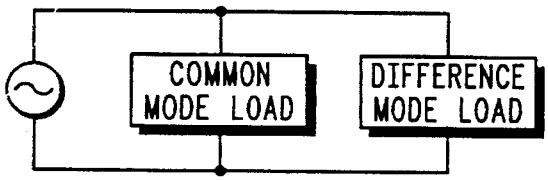
FIG. 3 is an illustration of a theoretical source and loads having a common mode load and a differential mode load.
Figure 2:
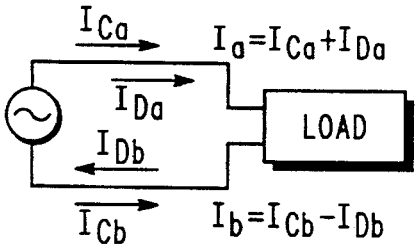
FIG. 2 is an illustration of a theoretical source and load, and their related currents.
Figure 4:
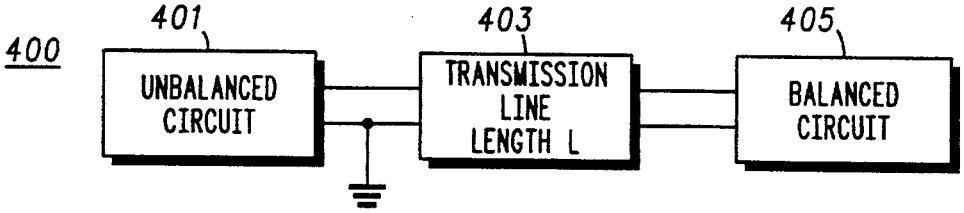
FIG. 4 is an illustration in block diagram form of a circuit in accordance with the present invention.

FIG. 4 is an illustration in block diagram form of a circuit in accordance with the present invention. The circuit 400 contains an unbalanced circuit 401, a transmission line of length "L" 403, and a balanced circuit 405. Here the unbalanced circuit 401 is coupled to the balanced circuit 405 through a transmission line 403 having a length "L" which is determined as part of the present invention is an implementation of the present invention in a portable radiotelephone.

Figure 5:
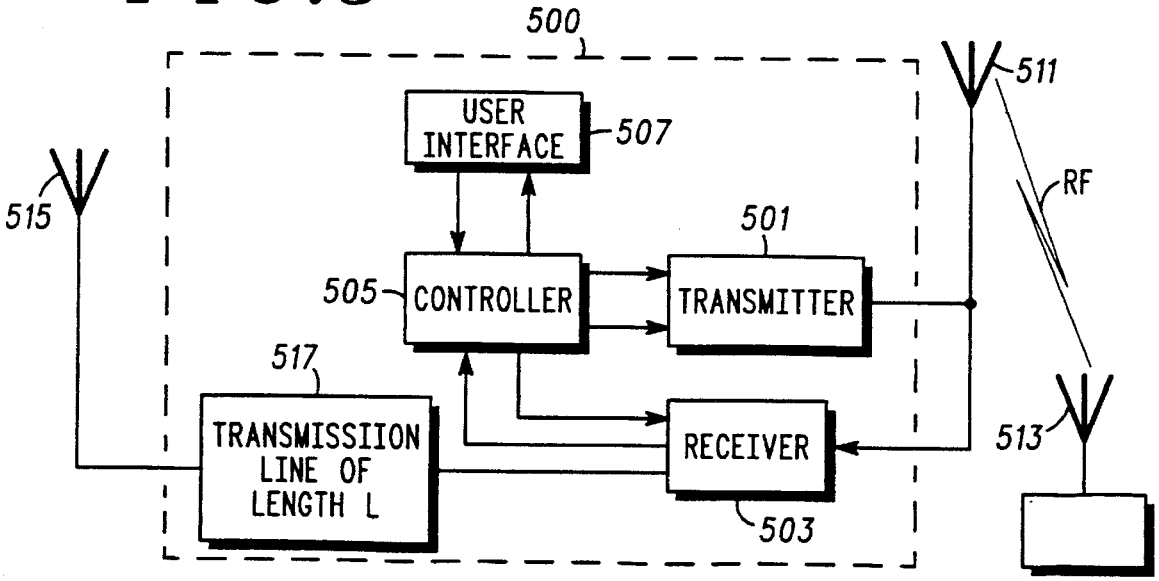
FIG. 5 is an illustration in block diagram form of a radio communication system in accordance with the present invention.

FIG. 5 is an illustration in block diagram form of a radio communication system which may employ the present invention. In the system, a remote transceiver 513 sends and receives radio frequency (RF) signals to and from mobile and portable radiotelephones contained within a fixed geographic area served by the fixed site transceiver 513. The radiotelephone 500 is one such radiotelephone served by the fixed site transceiver 513.

While receiving signals from the fixed site transceiver 513, the radiotelephone 500 uses a main antenna 511 and a diversity antenna 515 to couple the RF signal and convert the RF signal into an electrical RF signal. The electrical RF signal is received by the radio receiver 503, for use within the radiotelephone 500. The receiver 503 outputs a symbol signal for use by the controller 505. The controller 505 formats the symbol signal into voice or data for the user interface 507. The user interface 507 typically contains a microphone, a speaker and a keypad.

Upon the transmission of RF signals from the radiotelephone 500 to the remote transceiver 513, the controller 505 formats the voice and/or data signals from the user interface 507. The formatted signals are input into the transmitter 501. The transmitter 501 converts the data into electrical RF signals. The electrical RF signals are converted into RF signals and output by antenna 511. The RF signals are received by the remote transceiver 513.

As discussed earlier, the receiver 503 is an unbalanced load circuit and the diversity antenna 515 is considered a balanced source circuit for the purpose of the present invention. The transmission line 517 of length "L" is designed such that the common mode impedance is very high, and that the differential impedance is equal to that of the receiver and antenna circuits 503, 515. The requirements for a highly efficient antenna are to maximize the impedance of the common mode, and to match the impedance of the differential mode to the source and load. There are two basic parameters that affect the common mode impedance while maintaining the differential mode impedance as a match to the source; namely, the lateral size and the length of the transmission line. The lateral size or transverse dimensions of the transmission line (width and thickness) should be reduced to a minimum size, making the effective common mode inductance and impedance of the transmission line as high as possible. If the lateral dimensions are scaled properly, then the differential mode impedance can be maintained for any set of dimensions. The limit of this approach is that the dimensions become unmanufacturable, and the electrical loss in the differential mode becomes unacceptable.

A second method of increasing the common mode impedance while maintaining the differential mode impedance is to select a length of transmission line to be an integral number of half wavelengths from an open end. Referring now to the graph 600 of FIG. 6, the common mode current, illustrated as wave 601 goes through periodic one half wavelength cycles along its length. There are common mode current minima at end point (603), point B(605), and point D(607). Likewise, there are common mode current maxima at point A(609), point C(611), and point E (613). A similar pattern of common mode currents appears when the transmission line, such as transmission line 517, is terminated in a dipole antenna, such as the diversity antenna 515 of FIG. 5. Referring to the graph 700 of FIG. 7, the common mode current for a transmission line terminated in a dipole antenna is shown. Again, minima occur at point B(701), and point D(703), Likewise, maxima points occur at point A(705), point C(707); and point E(709). When a dipole antenna is added to the transmission line, the common current pattern, as illustrated in FIG. 7, shifts such that the first current minimum is at a point one quarter wavelength from the antenna feed point; determining the location of the other current minima. This effect can also be seen if the effective common mode impedance is plotted as a function of length from the end of the transmission line, as illustrated in FIG. 8. FIG. 8 shows the points A, C and E as shorts or very low impedance points directly across from the open or high impedance points, B, and D. The Smith chart of FIG. 8 appears as a spiral that circumscribes the chart several times. If a transmission line 517 is chosen to have a length ending at points B or D, then the common mode impedance would be very high and the power going into the common mode will be small, as desired in the case of the preferred embodiment.

The frequency of operation and the phase velocity determine the wavelength on the transmission line. The wavelength is equal to the phase velocity divided by frequency. For air, the phase velocity is equal to the speed of light. For other media, the phase velocity is equal to the speed of light divided by the square root often designated as Sqrt(), of the effective dielectric constant of the media, often designated as $\in_r$. For the common mode case the phase velocity is near that of free space, for the differential mode case the media is the flexible printed circuit material with a dielectric constant of 3.4. This will reduce the phase velocity to $1/\mathrm{Sqrt}(\in_r)$ or 0.55 times that of light in free space. These phase velocities are indeed quite different for the two cases. For the difference mode, the desire is to reduce reflections on the transmission line, such that the impedance is essentially independent of the length of the transmission line. However, for the common mode, the impedance is intentionally made to be very dependent upon the length and then the length is selected for the maximum impedance.

In order for these phenomena to be used to realize a balun function on a transmission line, the transmission line must be designed for each particular application using the design flow chart 900 illustrated in FIG. 9. The flowchart begins at starting point 901. First, at function block 903, one designs a balanced circuit without any consideration to what it will be connected. In the preferred embodiment, the balanced circuit is a dipole antenna used as the diversity antenna 515, as illustrated in FIG. 5. When designing a dipole antenna, it may be designed without a feedline for its desired frequency band. In the preferred embodiment, the desired frequency band for the antenna is 810–830 MHz (Megahertz). Second, at function block 905, one provides an unbalanced circuit. In the preferred embodiment, the receiver 503 of FIG. 5 is considered the unbalanced circuit. Third, at function block 907, one chooses a balanced transmission line for coupling between the balanced circuit and the unbalanced circuit. The transmission line should have a differential mode impedance equal to that of the source and a very high common mode inductance. The differential mode impedance often designated as Zo, generally is defined using the equation $$Zo=377*\text{thickness of the transmission line}/(\text{width of the transmission line}*Sqrt(\in_r))$$

If the source impedance, Zs, and the load impedance are equal, then the differential impedance is made equal to them.

For unequal source and load impedances, the transmission line will be more complex, such is the case in our preferred embodiment.

The length L to traverse the distance between the antenna and receiver has a differential mode phase length greater than the length needed to implement an impedance transformer, designated as Lt. This length is one quarter wavelength and is often designated as (λ/4). Therefore we have designed an inline (series) pair of transmission lines that perform the two functions required, namely:

1) rejection of the common mode load, and 2) transformation of the antenna source impedance, Zs, to match the receiver load impedance, Zl.

Before coupling the transmission line to the load circuit, choose the proper length "Lr" of the transmission line 517 that gives a common impedance much greater than the source impedance. In the preferred embodiment, the length, L, needed to reject the common mode, designated as Lr, is greater than the length needed for transformation, designated as Lt. Consequently, an additional length or excess length, designated as Le is required. This can be expressed in the equation below:

$$Lt+Le=Lr.$$

Figure 11:
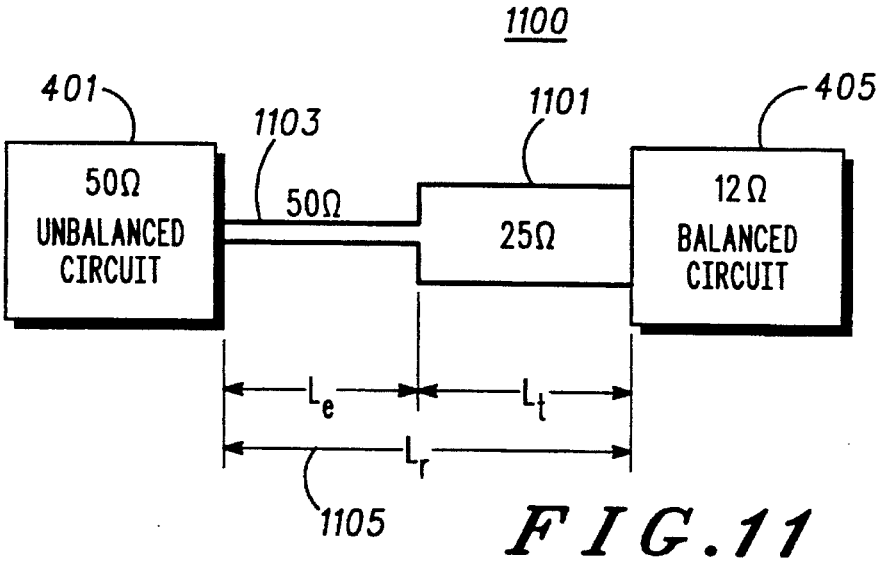
FIG. 11 is an illustration of individual lengths of a balun apparatus in accordance with the present invention.

The excess length would have the characteristic impedance of either the source or the load. Therefore, the excess length is chosen to have a characteristic impedance of the higher impedance of Zs or Zl. An illustration 1100 of the lengths associated with the impedance transformation, the common mode rejection and the excess length is found in FIG. 11. Excess length, $L_e$, is indicated at reference numeral 1103, the transformation length, $L_t$, is indicated at reference numeral 1101 and the rejection length, $L_r$ is indicated at reference numeral 1105. Thus, a portion of the transmission line comprises an impedance transformer along the transformation length, $L_t$. In the preferred embodiment the impedance of the load, Zl is equal to 50 Ohms and the dipole antenna has an impedance of 12 Ohms. Thus, a transmission line is illustrated having a differential mode impedance for $L_e$, 1103, of 50 Ohms and a transformer, $L_t$ section 1101, of 25 Ohms.

The transformer section of the transmission line has a length Lt which is defined by the frequency of interest and having a phase length of one quarter of a wavelength which may also be expressed as 90° which is λ/4. This phase length can be found using the earlier text provided. In the preferred embodiment the impedance of the load, Zl, is equal to 50 Ω and the dipole antenna has an impedance of 12 Ω. Thus, a transmission line was chosen having a differential mode impedance for Le, of 50 Ω and a transformer, Lt, section of 25 Ω. This transformer matches the antenna source impedance, Zs, of 12 Ω to the receiver load impedance, Zl, of 50 Ω.

By choosing the proper length "Lr" of the transmission line, a balun function is realized. Although the transmission line is now limited to a predetermined length "Lr", additional circuitry or components such as transistors, or additional transmission lines or coaxial cable are no longer necessary, thus reducing the physical size constraints required for realizing a balun function.

Figure 10:
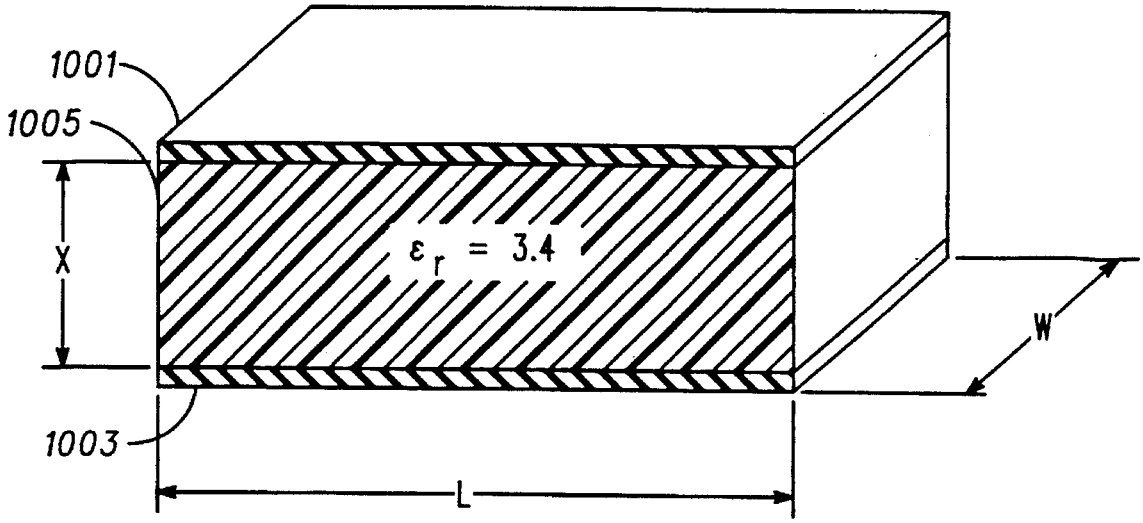
FIG. 10 is an illustration of a transmission line in accordance with the present invention.

FIG. 10 is a detailed illustration of transmission line 403 of FIG. 4. A first conductor 1001 has a length, L, a width, W, and is made of metal and shaped as a planar strip. The first conductor 1001 is separated from a second conductor 1003 by a distance X. The second conductor 1003 also has a length, L, a width, W, and is made of metal and shaped as a planar strip. A flexible plastic material 1005 separates the first conductor 1001 from the second conductor 1003. As previously mentioned this flexible plastic material 1005, otherwise known as flexible printed circuit material has an $\epsilon_r$=3.4.

What is claimed is:

1. A balun apparatus directly connected between a balanced circuit and an unbalanced circuit, the balanced and unbalanced circuits operating in a common mode and a differential mode, the balun apparatus comprising:

a first conductor having a first length; and a second conductor having a second length equal to the first length and the second conductor being parallel to the first conductor, the second conductor separated from the first conductor by a first distance, the first conductor and the second conductor defining a first transmission line having a first impedance for the differential mode operation and a second impedance for the common mode operation, and the first transmission line is directly connected between the unbalanced circuit and the balanced circuit, wherein a first portion of the first transmission line further comprises an impedance transformer having an arbitrary ratio, and the impedance transformer has a length which is equal to a transformation length, Lt, of the first transmission line, the transformation length substantially equal to a quarter wavelength of a frequency of interest or a multiple thereof.

2. A balun apparatus of claim 1 further comprising respective planar metal strips for the first conductor and for the second conductor.

3. A balun apparatus of claim 2 further comprising flexible plastic material to provide the separation of the first conductor from the second conductor.

4. A radio communication device comprising:

a balanced antenna having a first common mode source impedance and a first differential mode source impedance;

an unbalanced radio receiver having a differential load impedance; and a two conductor transmission line directly connected between a terminal of the balanced antenna and a terminal of the unbalanced radio receiver, the transmission line having a predetermined length, a second common mode impedance and a second differential mode impedance, the first common mode impedance and the second common mode impedance realizing a common mode input impedance and the first differential impedance and the second differential mode impedance realizing a differential mode input impedance, the common mode input impedance being substantially larger than the common mode source impedance, the differential input impedance is substantially matched to the source impedance, wherein a first portion of the two conductor transmission line further comprises an impedance transformer having an arbitrary ratio, and the impedance transformer has a length which is equal to a transformation length, $L_t$, of the two conductor transmission line, the transformation length substantially equal to a quarter wavelength of a frequency of interest or a multiple thereof.

5. A radio communication device of claim 4 wherein the two conductor transmission line further comprises a first planar metal strip for a first conductor thereof and a second planar metal strip for a second conductor thereof, the second conductor being parallel to and separated from the first conductor.

6. A radio communication device of claim 5 wherein the two conductor transmission line further comprises flexible plastic material to provide the separation of the first conductor from the second conductor.

7. A balun apparatus directly connected between a balanced circuit and an unbalanced circuit, the balanced and unbalanced circuits operating in a common mode and a differential mode, the balun apparatus comprising:

a first conductor having a first length; and a second conductor having a second length equal to the first length and the second conductor being parallel to the first conductor, the second conductor separated from the first conductor by a first distance, the first conductor and the second conductor defining a first transmission line having a first phase velocity for the differential mode operation and a second phase velocity for the common mode operation, and the first transmission line is directly connected between the unbalanced circuit and the balanced circuit, wherein a first portion of the first transmission line further comprises an impedance transformer having an arbitrary ratio, and the impedance transformer has a length which is equal to a transformation length, Lt, of the first transmission line, the transformation length substantially equal to a quarter wavelength of a frequency of interest or a multiple thereof.

8. A balun apparatus of claim 7 further comprising respective planar metal strips for the first conductor and for the second conductor.

9. A balun apparatus of claim 8 further comprising flexible plastic material to provide the separation of the first conductor from the second conductor.

* * * * *